US006599306B1

(12) United States Patent
Reil

(10) Patent No.: US 6,599,306 B1
(45) Date of Patent: Jul. 29, 2003

(54) EAR PIERCING CARTRIDGE AND STUD GUN SYSTEM

(76) Inventor: Vladimir Reil, 521 W. Rosecrams, Los Angeles, CA (US) 90248

( * ) Notice: Subject to any disclaimer, the term of this patent is extended or adjusted under 35 U.S.C. 154(b) by 194 days.

(21) Appl. No.: 09/690,311

(22) Filed: Oct. 17, 2000

(51) Int. Cl.[7] ..... A61B 17/00
(52) U.S. Cl. ..... 606/188
(58) Field of Search ..... 606/188, 185, 606/117; 227/67, 73, 134

(56) References Cited

U.S. PATENT DOCUMENTS

| | | | | | |
|---|---|---|---|---|---|
| 3,945,089 | A | | 3/1976 | Gagnon | |
| 4,146,032 | A | * | 3/1979 | Rubenstein et al. | 606/188 |
| 4,184,343 | A | | 1/1980 | Green | |
| 4,195,492 | A | | 4/1980 | Johnson | |
| 4,214,456 | A | | 7/1980 | Hannum | |
| 4,259,850 | A | | 4/1981 | Lalieu | |
| 4,397,067 | A | | 8/1983 | Rapseik | |
| 4,631,929 | A | | 12/1986 | Hollingworth | |
| 4,907,425 | A | | 3/1990 | Elkin | |
| 5,004,471 | A | | 4/1991 | Mann | |
| 5,140,840 | A | | 8/1992 | Miceli | |
| 5,154,068 | A | | 10/1992 | DiDomenico | |
| 5,201,197 | A | | 4/1993 | Bakker | |
| 5,454,829 | A | | 10/1995 | Koland | |
| 5,456,094 | A | | 10/1995 | Greenwald | |
| D366,316 | S | | 1/1996 | Reil | |
| 5,496,343 | A | * | 3/1996 | Reil | 606/188 |
| 5,499,993 | A | | 3/1996 | Blomdahl et al. | |
| 5,588,309 | A | | 12/1996 | Chioffe | |
| 5,632,163 | A | | 5/1997 | Inoue | |
| D384,302 | S | | 9/1997 | Reil | |
| 5,675,987 | A | | 10/1997 | Nakajima | |
| D392,042 | S | | 3/1998 | Reil | |
| 5,743,113 | A | | 4/1998 | Kogen | |
| 5,792,170 | A | | 8/1998 | Reil | |
| 5,868,774 | A | * | 2/1999 | Reil | 606/188 |
| 6,036,712 | A | | 3/2000 | Blomdahl | |

FOREIGN PATENT DOCUMENTS

| | | |
|---|---|---|
| JP | 08196313 | 8/1996 |
| JP | 08322615 | 12/1996 |
| JP | 09224722 | 9/1997 |
| WO | WO 92/09218 | 6/1992 |

* cited by examiner

*Primary Examiner*—Peter Nerbun
(74) *Attorney, Agent, or Firm*—Gates & Cooper LLP

(57) ABSTRACT

A system for providing pierced-ear instruments. The invention provides an earring cartridge carrying a stud having a post in a stud post holder assembly and a nut in slidably aligned, spaced apart, and oppositely opposed placement so that an ear part may be placed between the post and the nut for piercing wherein a torque-like force is produced on the stud post holder assembly causing the assembly to rotatably open when the earring cartridge is compressed to bring the stud towards the nut for engaging the post with the nut. The rotatable opening of the stud post holder assembly facilitates the disengagement of the assembly from the earring stud after the stud has connected to the nut, eliminating the need to touch the ears of the customer to confirm the stud-nut connection or to remove the assembly after the ear piercing is completed. A vertically stackable packing box maintains a sterile environment in which an earring cartridge with a pierced-ear earring stud may be transported and stored. An earring-cartridge stud gun provides a cradle into which the earring cartridge may fit.

38 Claims, 6 Drawing Sheets

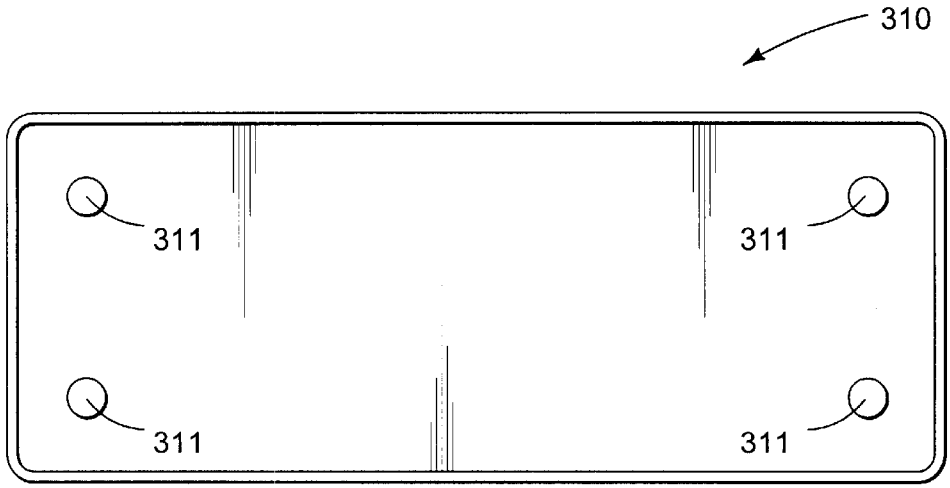
FIG. 12A
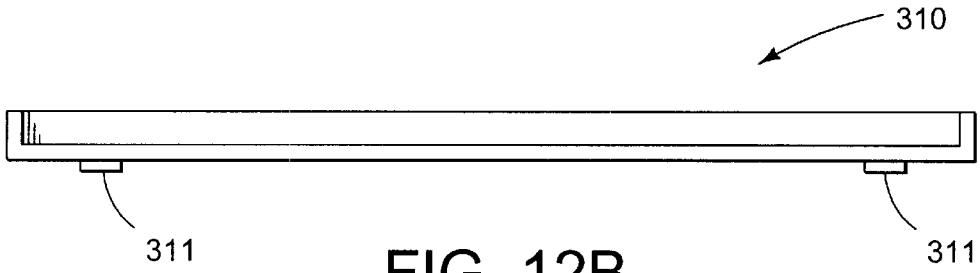
FIG. 12B
FIG. 13A
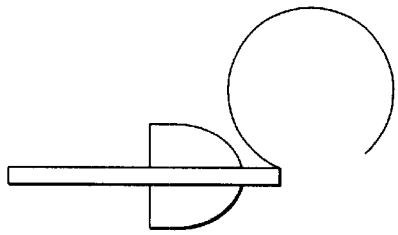
FIG. 13B
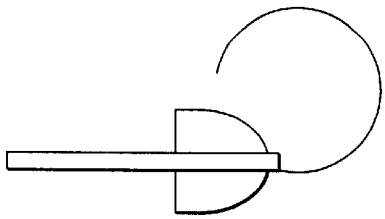

EAR PIERCING CARTRIDGE AND STUD GUN SYSTEM

FIELD OF THE INVENTION

This invention relates to ear-piercing devices and, more particularly, to an ear-piercing cartridge and stud gun system with a stackable packing box for the cartridge.

BACKGROUND OF THE INVENTION

Ear piercing is increasingly becoming a commonplace fashion statement. In the past, ear piercing has been a procedure performed by a doctor or other medical practitioner, such as a nurse. Increasingly, more routine procedures are used to pierce ears. Such procedures are often performed by laypersons without medical experience or training. To this end, a number of approaches and designs have been made to provide simple, manually operated devices that allow for the safer, hygienic, user-friendly piercing of ears.

Examples of such systems are disclosed in U.S. Pat. No. 5,496,343 issued to Reil on Mar. 5, 1996, application Ser. No. 292,249 filed Aug. 18, 1994, U.S. Pat. No. 5,792,170 issued to Reil on Aug. 11, 1998, application Ser. No. 754,411 filed Nov. 21, 1996, and U.S. Pat. No. 5,868,774 issued to Reil on Feb. 9, 1999, application Ser. No. 8,763 filed Jan. 19, 1998, all of which are incorporated herein by this reference.

The Reil '774 Patent describes the latest ear-piercing system in the evolution towards developing a simple, easy to use, safer, hygienic, user-friendly, manually operated device. The '774 Patent describes an ear-piercing apparatus that is comprised of an earring cartridge which holds an earring stud and an earring nut in two opposed jaws, i.e., an earring jaw and a nut jaw. The stud is held within a stud post holder assembly (also called "pierced-ear earring cartridge" in the Reil '774 Patent), which is a module that disassembles into two pieces. One of these pieces has a frangible and breakable tab at its rear.

Although, the '774 Patent describes a simple, easy to use ear-piercing system, when it is used to pierce an ear, the two pieces of the stud post holder assembly may stay attached to the stud and sometimes require manual removal from the earring. Further, on occasions when the two pieces come off the stud, they fall out of the assembly, sometimes into the ear or onto the body of the subject whose ears are being pierced and at other times onto the floor.

Moreover, the reliance of tie '774 Patent on the frangible tab has design limitations. First, the breaking of the tab causes an unwanted noise that is often a source of distress or concern for the customer. Second, the use of the frangible tab leads to only discrete control over the ear-piercing process. In the invention of the '774 Patent, when the earring assembly is squeezed, either holding it in a hand or mounted in an ear-piercing gun, the presence of the frangible tab implies that once the earring assembly is squeezed to the point of breaking the tab, the ear is pierced automatically. Thus, it prevents continuous control of the exact location and timing of the ear-piercing process.

Additionally, the ear-piercing system of the '774 Patent and its predecessors have not been designed to provide consistent ear piercing with hinged hoop earrings, which is an important product in the ear-piercing market.

Finally, the '774 Patent discloses a sterilizable blister pack for storing and transporting the earring cartridge. While such a packing is a convenient, effective sterilizable packing for the cartridge, it does not provide rigid, vertical stackable storage for earring cartridges.

SUMMARY OF THE INVENTION

The present invention solves the preceding problems, representing a quantum improvement in the design and operation of ear-piercing systems.

In a general embodiment, the present invention is an earring cartridge and stud gun system for providing sterile ear piercing comprising an earring cartridge carrying a stud having a post in a stud post holder assembly and a nut in slidably aligned, spaced apart, and oppositely opposed placement so that an ear part may be placed between the post and the nut for piercing wherein a torque-like force is produced on the stud post holder assembly causing the assembly to rotatably open when the earring cartridge is compressed to bring the stud towards the nut for engaging the post with the nut. The rotatable opening of the stud post holder assembly facilitates the disengagement of the assembly from the earring stud after the stud has connected to the nut, eliminating the need to touch the ears of the customer to confirm the stud-nut connection or to remove the assembly after the ear piercing is completed.

In a preferred embodiment, the earring cartridge comprises a nut jaw for holding the nut and an earring jaw for holding the stud post holder assembly, which carries the stud. The assembly is in two halves with each half having a front stud head adaptor, a main body and an L-shaped terminal member having a base and a leg. The terminal members ride in intermediate channels in the earring jaw and when the earring cartridge is squeezed the main body of the post holder assembly slides over a flexible tang and the base of the terminal members slides over a hump attached to the tang.

The invention also provides for convenient hygienic transport and storage of the cartridge in the form of a stackable packing box which contains a robust seal to maintain the cartridge in a sterile environment.

If the invention is used with a stud gun, the earring cartridge is used by placement while loading within the cradle of the gun, the cradle receiving and removing the earring cartridge from the stackable packing box to provide and maintain the stud and the nut assembly in an aligned position for piercing the ear without any necessity of coming in direct contact with the sterile earring cartridge with the hands of the operator.

OBJECTS OF THE INVENTION

It is an object of the present invention to provide a more effective means by which ears may be pierced. In particular, the present invention seeks to provide an ear-piercing system in which the stud holding module separates from the stud cleanly as soon as the ear is pierced. Further, the present invention provides a system whereby the components of the stud holder module remain within the earring cartridge after an ear is pierced. This eliminates the possibility of the module components falling into the ear or body of the subject being pierced or onto the floor, forcing the ear piercer to look for them following the ear piercing operation.

It is another object of the present invention to provide a higher level of accuracy for ear-piercing by means that are more controllable and more expertly handled by persons without the requirement of a high degree of training. In particular, the present invention seeks to provide an ear-piercing system that can be finely controlled by the ear-piercer whereby the ear-piercer need not commit to piercing an ear until they are completely certain that they want to.

Further, the invention seeks to provide an effective ear-piercing system in which hinged hoop earrings can be utilized.

It is yet another object of the present invention to provide an ear-piercing methodology that creates, protects and maintains sterile ear-piercing instruments prior to the actual piercing.

It is an additional object of the present invention to provide sterilizable and sterile means by which the disposable, one-use, ear-piercing cartridges may be transported and stored in a sterile condition until ready for use.

It is an additional object of the present invention to provide a hand-held stud gun that can engage an earring cartridge to better control the cartridge during the ear-piercing process.

It is yet another object of the present invention to provide a sterilizable and sterile stackable packing boxes that facilitates engagement and disengagement by an earring cartridge with a stud gun and which earring cartridge is resistant to reuse to ensure that the same is not reused.

These and other objects and advantages of the present invention will be apparent from a review of the following specification and accompanying drawings.

BRIEF DESCRIPTION OF THE DRAWINGS

FIGS. 12A and 12B are the plan and elevation views of the packing box bottom; and FIGS. 13A and 13B show two alignments of a hinged hoop earring.

DETAILED DESCRIPTION OF THE PREFERRED EMBODIMENTS

The system of the present invention involves the use of an earring-cartridge that provides better control over, optimizes operation and, therefore, is safer use of an earring cartridge. The earring-cartridge stud gun of the invention and the system incorporating its use provides means by which precise control can be exerted and maintained over the earring cartridge while allowing the stronger palm muscles of the hand to drive the ear-piercing process. The earring cartridge of the present invention provides a stud post holder assembly that opens rotatably releasing the stud cleanly and retaining the assembly components within the cartridge when an ear is pierced.

Additionally, the invention uses sterile stackable packing means for convenience of storage and to create and maintain a sterile environment for the earring cartridge, the stud post holder assembly, and the earring during transport and storage. The stackable packing also provides sterile means by which the caning cartridge will be maintained in a sterile environment until use, allowing the manipulation and articulation of the earring cartridge without requiring direct contact with human hands or other contaminated and contaminating surfaces. By sterilizing the contact area between the earring-cartridge stud gun and the earring cartridge, a completely sterile environment can be maintained for the instruments used for the ear-piercing process.

Figure 1:
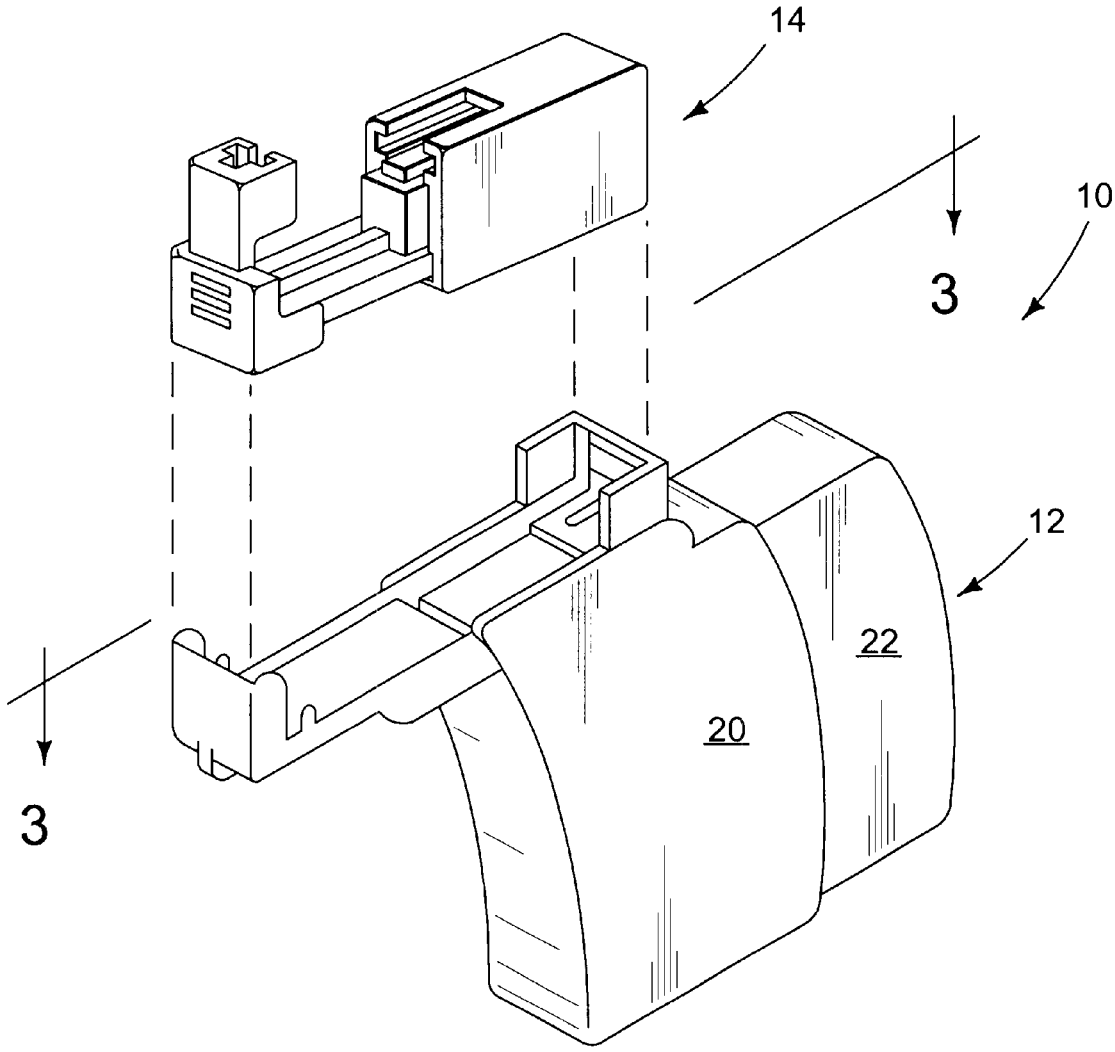
FIG. 1 is an exploded perspective view of the ear-piercing system of the present invention.
Figure 10:
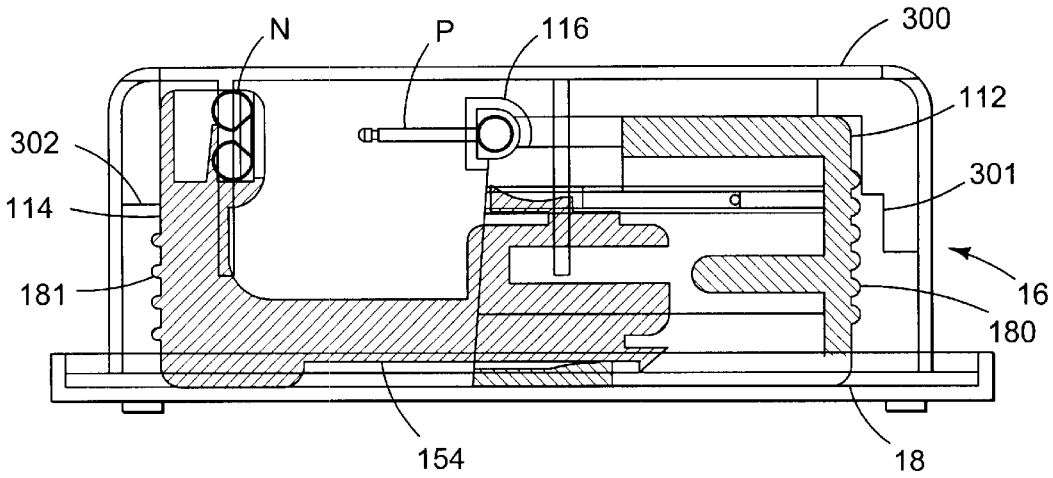
FIG. 10 shows an earring cartridge inside a stackable packing box.

Generally, the figures show the construction and operation of the earring-cartridge stud-gun system. Referring to FIGS. 1 and 10, the earring-cartridge-and-stud gun system 10 of the present invention is comprised of the earring-cartridge stud gun 12, the earring cartridge 14, and the earring cartridge stackable box (FIG. 10). Initially, a pierced-ear earring is fitted within a stud post holder assembly 116 (FIG. 10). The stud post holder assembly 116 is then fitted within the earring cartridge 14. The earring cartridge 14 with the earring stud P and nut N fits within the stackable box 16 which is constructed to conform to the exterior shape of the earring cartridge 14. The stackable box 16 is sealed by removable medical-grade paper 18 adhesively sealed to the top container of the stackable box 16. After sealing one or more of the blister packs, sterilizing gas may be used to sterilize the stackable box 16 so that the interior thereof and any contents, including the earring cartridge 14 and earring stud P and nut N are sterilized and it stays sterile until used. Obviously, irradiation for sterilization may be used. During transport and storage, the sterile environment created inside the stackable box 16 is maintained until the seal is broken by removal of the peelable paper backing 18 just prior to the use of the earring cartridge 14 during the ear-piercing process.

The earring cartridge 14 fits within the earring-cartridge stud gun 12 so that a person's entire hand, not just the fingers, may be used to wield and control the pierced-ear earring prior to and during the ear-piercing process. The cartridge is also provided with a plurality of ribs 180, 181 on its outside surface so that the cartridge itself may be used without the stud gun for ear piercing.

Figure 2:
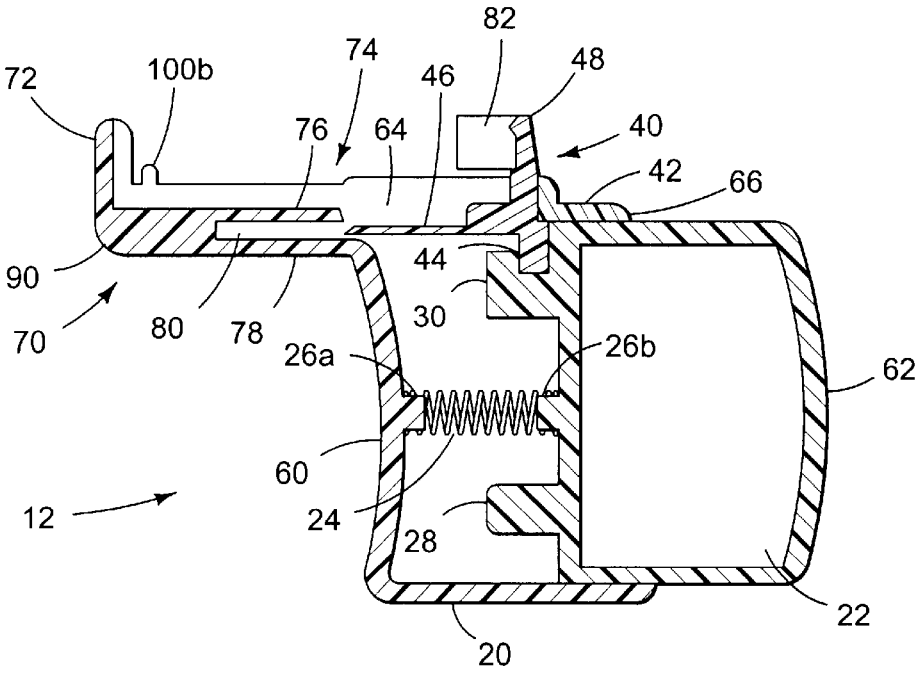
FIG. 2 is a side cross-sectional view of the ear-piercing cartridge stud gun taken along line 3—3 of FIG. 1.
Figure 3:
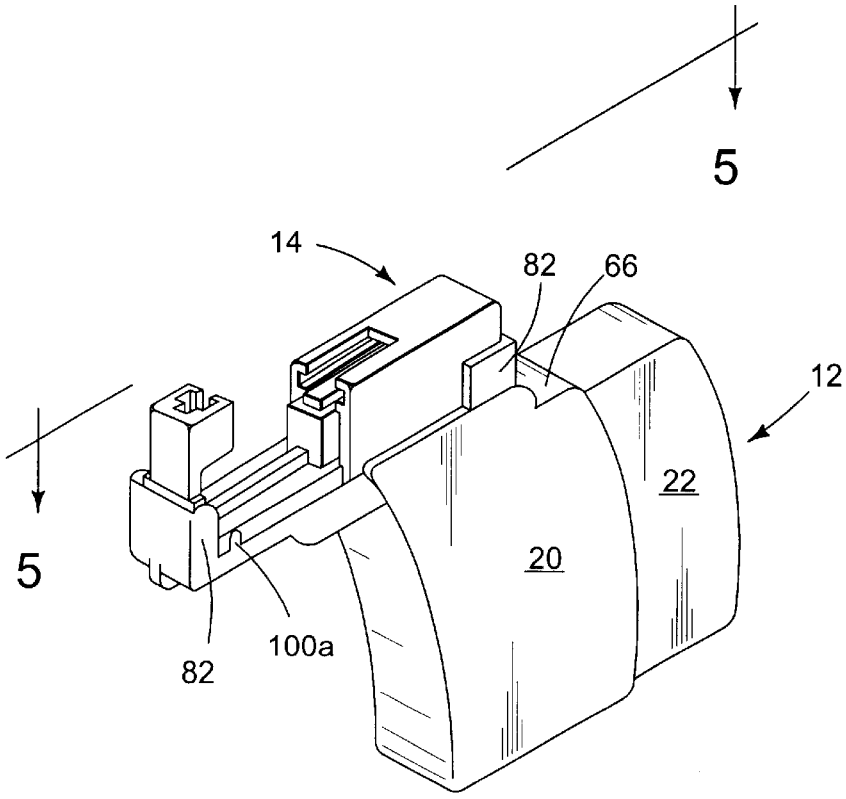
FIG. 3 is a perspective view of the associated ear-piercing cartridge and stud gun when fitted to each other.
Figure 4:
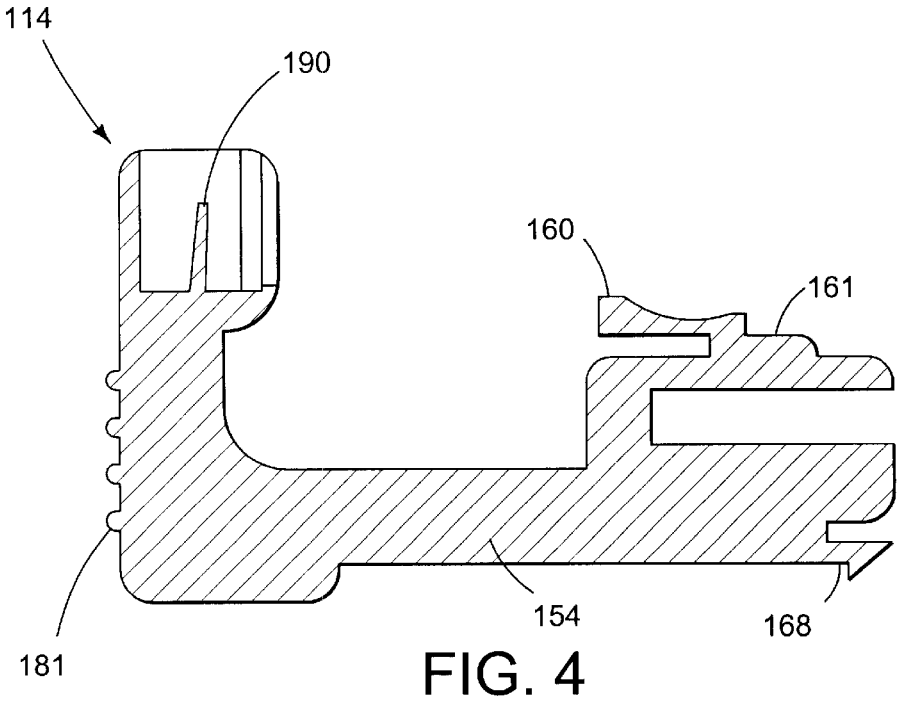
FIG. 4 is a side cross-sectional view of the nut jaw.
Figure 5:
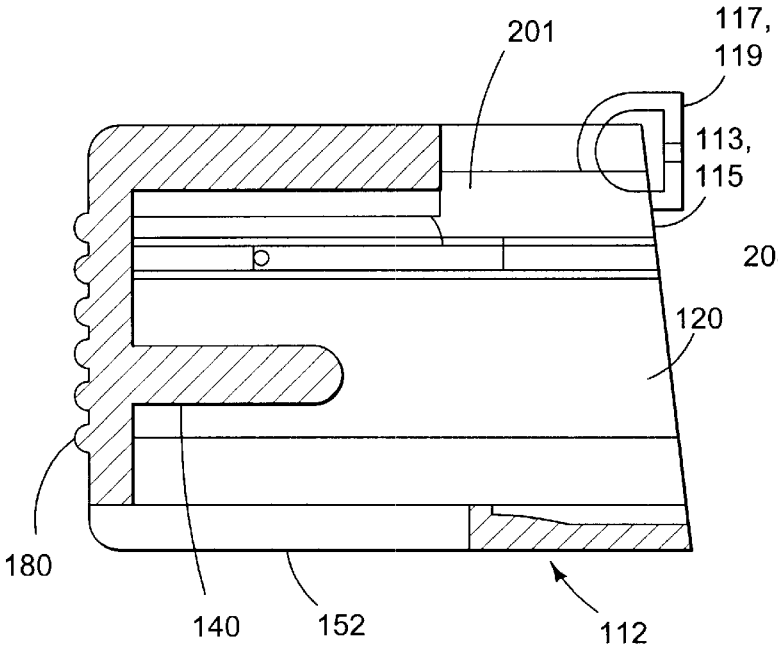
FIG. 5 is a side cross-sectional view of the earring jaw with the stud.
Figure 6:
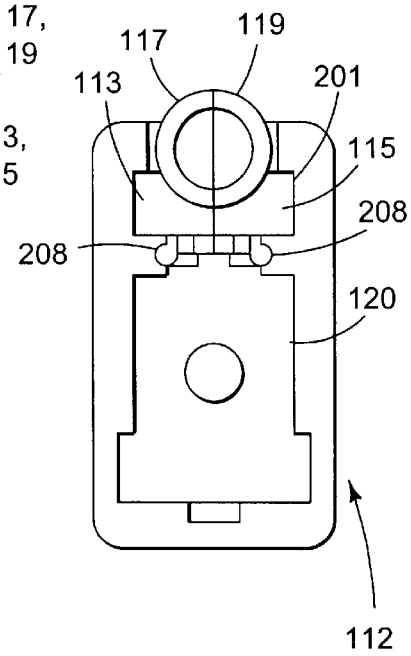
FIG. 6 is a front cross-sectional view of the earring jaw and stud post holder assembly.

The earring-cartridge stud gun 12 is shown in FIGS. 2–3 wherein two inter-fitting portions comprise the earring-cartridge stud gun 12: the grip 20 and the plunger 22. The plunger 22 fits within the grip 20 and slidably travels there through a generally short distance, namely, that distance necessary to pierce the ear with the stud portion of the pierced-ear earring. That distance of travel is approximately one-half inch and the plunger 22 is easily controlled by the hand. The length of the plunger-grip assembly is approximately two-and-one-half inches taken along the line 5—5 as shown in FIG. 3.

As shown in FIG. 2, the plunger 22 is biased by biasing means, such as spring 24, away from the grip 20. Oppositely disposed stud-gun spring posts 26a, b serve to hold spring 24 in place between the grip 20 and the plunger 22 in a normally-opposed position. The plunger 22 is held in captive association with grip 20 as set forth in more detail below.

The plunger 22 may be hollow in order to conserve cost, weight and to allow for greater ease of manufacturing. On the inside of the plunger 22 within the grip 20, lower abutment stop 28 and an upper abutment stop 30 serve to limit the forward travel of plunger 22 into the interior of the grip 20. The distance between the contact surfaces of the abutment stops 28, 30, and the grip 20 is approximately one-half inch. The abutment stops 28, 30 may be formed of the same material as the plunger 22 and may be molded as an integral unit with plunger 22.

Upper abutment stop 30 is formed in an L-shape (in cross section) so as to accommodate the traveling portion 40 of the cradle 74 provided by the earring-cartridge stud gun 12 for the earring cartridge 14. The traveling portion 40 has a depending projection 42 that fits within the notch 44 provided between the upper abutment stop 30 and the plunger 22. Tongue 46 projects laterally forward and away from the plunger 22 to act as an additional travel limiting stop as will be seen. A cradle backstop 48 serves to provide the retaining support and abutment at the back of the earring cartridge 14 once it is fitted into the earring-cartridge stud gun 12 and more specifically, cradle 74 thereof.

Traveling portion 40 is molded as one piece with plunger 22 or may be welded thereto so as to be integral with plunger 22. The traveling portion 40 travels with the plunger 22 due to its connection with the upper abutment stop 30 via the depending portion 42. Along with the plunger 22, the traveling portion 40 slidably travels along any surface of the grip 20 with which it may come into contact except where abutment occurs.

The grip portion 20 has a front-curved surface 60 adapted to fit against the fingers of the hand. In conjunction with the rear-curved surface 62 of the plunger 22, the portion of the earring cartridge stud gun 12 engaged by a person's hand fits comfortably within the hand due to the complementary curved surfaces 60, 62. The grip portion 20 is approximately two inches in height, about three inches in overall width, and defines upper slot 64 through which the cradle backstop 48 travels. An abutment or end wall 66 of the slot 64 of the grip portion 20 serves to prevent the rearward travel of the cradle backstop 48 beyond that shown. The abutment 66 between the cradle backstop 48 holds the plunger 22 in sliding association with the grip 20, even though biasing means 24 normally urges them apart.

Projecting forwardly from the top of the grip 20 is a cradle extension 70 that terminates in a cradle forestop 72. The area defined between the cradle forestop 72 and the cradle backstop 48 serves to define a cradle 74 within which the earring cartridge 14 may fit and be telescopically compressed during the ear-piercing process. Provided beneath the upper surface 76 and above the lower surface 78 of the cradle extension 70 is a tongue groove 80. The tongue groove 80 provides travel room for the tongue 46 as it travels forward. As the tongue 46 is captively retained between the upper surface 76 and the lower surface 78 of the cradle extension 70, greater stability and alignment is provided during the ear-piercing process as the cradle 74 maintains its relative geometry and shape during the piercing process.

In order to provide additional support to the cradle extension 70, integrally molded cradle extension support 90 extends forward of the tongue groove 80 and terminates below the forestop 72. The cradle extension support 90 provides additional support to the cradle extension 70.

The interior of the cradle 74 has additional means by which the earring cartridge 14 is held and maintained in position. Thus, oppositely disposed across the cradle 74 adjacent the forestop 72 are two side supports 100*a, b*. The cradle side supports 100*a, b* project upwardly approximately an eighth of an inch and provide additional side securement and positioning for the earring cartridge 14. The interior of the backstop 48 and forestop 72 may have notches or ridges by which to engage the ribs 180, 181 present on the earring cartridge 14. In one embodiment, a small extension or finger (not shown) may extend upwardly from the upper surface 76 of the cradle extension 70 adjacent the forestop 72 to frictionally engage the front end of the earring cartridge 14. Both the backstop 48 and the forestop 72 may have side flange projections 82 to better engage and secure the earring cartridge 14 in the cradle 74.

As shown in FIG. 10, the earring cartridge 14 has two slidably connected portions. The earring cartridge fits within the cradle 74 provided by the earring-cartridge stud gun 12.

Generally, the invention's earring cartridge 14 comprises a stud post holder assembly 116 for holding the stud P, an earring jaw 112 for movably carrying the stud post holder assembly 116, and a nut jaw 114 for alignedly holding the nut N opposite the stud P, the nut jaw 114 having a nut jaw extension 154 for slidably engaging the nut jaw 114 with the earring jaw 112. The nut jaw extension 154 and the stud post holder assembly 116 interact to produce a torque-like force on the stud post holder assembly 116 causing it to rotatably open upon the assembly moving through the earring jaw 112 when the earring cartridge is compressed to bring the earring jaw 112 towards the nut jaw 114 for engaging the post with the nut. The nut N of the present invention is preferably provided with a backing shield (not shown) to prevent the end of the stud post from contacting a subject's body after the stud post is engaged by the nut.

Referring to FIGS. 5–9, the stud post holder assembly 116 for holding the stud is in two halves, each half comprising main body 113, 115, front stud head adaptors 117, 119 attached to the front side of the body and L-shaped terminal members with legs 125, 127 and bases 204, 205 attached to the rear side of the body 113, 115. The front stud head adaptors 117, 119 are recessed to receive the stud head and form a through hole adapted to hold a hinged hoop earring stud (not shown). The top surface of the earring jaw has a radial cavity such that a stud post holder assembly carrying a hinged hoop can be accommodated in it. Enough room is provided so that a hinged hoop earring can be held within the stud post holder assembly such that the hoop can curve away from the stud (FIG. 13A) or, in an alternative arrangement, curve towards the stud (FIG. 13B).

The stud post holder assembly 116 fits within a top channel 201 of the earring jaw 112. The body of each half of the stud post holder assembly 116 is held within the top channel such that the stud post holder assembly 116 can slide in and out of the earring jaw 112. A bottom channel 120 is adapted for slidably engaging the nut jaw extension 154. The bottom channel 120 serves as a guidance and alignment means for the nut jaw extension 154 with its base 152.

The earring jaw 112 further comprises a nut jaw retention system comprising a bottom side 152 of the earring jaw 112 adjacent the bottom channel and defining an opening 155 between an interior and an exterior of the earring jaw 112. The opening 155 is parallel to a length of the bottom side and extends from a rear portion of the earring jaw 112 to a point just past a midpoint between the rear portion and a front portion of the earring jaw 112 and accommodates an extending tongue 168 with a hook coupled to the nut jaw 114. When the tongue 168 is introduced into the opening 155 the hook may travel along the opening 155 and may be caught at a forward end thereof at the point just past the midpoint.

The earring jaw 112 also comprises a biasing engagement mechanism for engaging the earring jaw 112 and the nut jaw 114 that also tends to urge the earring jaw 112 away from the nut jaw 114. In the embodiment shown in FIG. 5, the mechanism comprises a spring post 140 which is coupled centrally to an interior rear wall of the bottom channel, and extends into the bottom channel generally parallel to a bottom side approximately one-quarter the distance between a rear and a front of the earring jaw 112.

Additionally, the earring jaw 112 comprises a plurality of ribs 180, which are present on an exterior of the earring jaw 112, generally opposite the bottom channel, the ribs 180 providing means by which secure manual engagement may be made of the exterior of the earring jaw 112.

The nut jaw 114 comprises nut holding means for holding a nut corresponding to an earring post in alignment with the earring post, extension means for extending the nut holding means away from the earring jaw 112 and slidable engagement means for slidably engaging the earring jaw 112, the slidable engagement means coupled to the extension means.

In a preferred embodiment, the nut holding means further comprise a nut holder and support means for supporting the nut holder in a spaced apart relationship with the extension means. Further, the nut holder may comprise a block, 191 coupled to the support means and defining first and second nut grooves within which an earring nut N may fit. The first nut groove 192 is perpendicular to the second nut groove 193; and a finger 190, which rises up from the floor of the block 191 in the first groove, and is capable of engaging with slight compression a nut fitted in the first and second nut grooves whereby the nut may be securely held in place by the finger 190 in the first and second grooves of the block yet easily disengaged from the block.

Also, the support means for supporting the nut holder may comprise an upright portion 194 supporting the block away from the extension means whereby a void is defined between the upright portion, the extension means, and the earring jaw 112 to provide room for an ear, the upright portion having a width approximately the same as a width of the earring jaw 112 to provide means by which the nut jaw 114 may be manually engaged. A plurality of ribs 181 is present on an outward facing portion of the upright portion opposite the void, and provides means by which secure manual engagement may be made of the exterior of the nut jaw 114.

The extension means comprise a base portion which is coupled to the nut holding means. The base portion has a width approximately the same as the width of the earring jaw 112 to provide means by which the nut holding means may be sturdily supported and provides a means by which the nut jaw 114 may be engaged by the earring jaw 112 thereby obstructing further slidable travel of the nut jaw 114 into the earring jaw 112. Further, a neck portion is coupled to the base portion and has a width approximately the same as a width of the bottom channel 120 so that the neck portion may slide into the bottom channel 120. The extension means may further comprise a tongue portion 168, which extends from the neck portion and terminates in a hook. The tongue portion 168 descends at an angle from the neck portion whereby the catch may engage a terminal end of the opening 155 present in a bottom side of the earring jaw 112.

In one embodiment, the slidable engagement means comprise an elongated portion slidably engaging the interior of the bottom channel. The elongated portion may define a bore wherein the bore is defined by first and second nut jaw extensions, the first nut jaw extension 169 extending above the bore and the second nut jaw extension 170. The first and second nut jaw extensions have oppositely opposed curved sections that serve to retain the biasing means within the bore and that serve to define corresponding gaps between the first and second nut jaw extensions and wherein the biasing means is a spring (not shown).

The earring jaw 112 may further comprise two intermediate channels 208 configured to adaptably receive the leg 125, 127 of the terminal member of each half of the stud post holder assembly 116 whereby the legs slide within the intermediate channels 208 when the stud post holder assembly 116 slides in and out of the earring jaw 112. The earring cartridge also comprises a flexible tang 160 and a hump 161 juxtaposed with the flexible tang 160 such that when the rear end of the body of the stud post holder assembly 116 moves past the flexible tang 160, the bases 204, 205 of the terminal members are forced up onto the hump 161. In one embodiment, the length of the flexible tang 160 is shorter than that of the legs 125, 127 of the terminal members. Additionally, the flexible tang 160 may be moldably attached to the hump 161. Further, the hump 161 may be attached to the upper surface of the nut jaw extension 154.

The invention also provides that the flexible tang 160 is flared upward to engage an underside of the post holder assembly 116 so as to better open the assembly 116 once the assembly 116 moves past the tang 160.

A preferred embodiment of the invention provides a peg and hole alignment system for the two halves of the stud post holder assembly 116 comprising a peg jutting out of the outer surface of one body and the other body having a cavity sized to adaptably receive the peg such that when the two halves of the stud post holder assembly 116 are assembled together in alignment the peg is received within the cavity.

The earring cartridge and stud gun system of the invention may or may not include an earring cartridge stud gun 12. When it does not include a stud gun, the earring cartridge alone may be used for ear piercing. If it includes a stud gun, the earring cartridge stud gun 12 for engaging the earring cartridge may comprise a grip 20; a plunger 22, the plunger 22 slidably engaging the grip 20; biasing means for biasing the plunger 22 away from the grip 20, the grip 20 having a front curved surface conformably engageable with the fingers of the hand of an operator, a cradle extension projecting forward of the front curved surface, the cradle extension having an upper surface spaced apart from a lower surface to define a tongue groove; and a cradle forestop projecting upwardly from an end of the cradle extension, the plunger 22 having a rear curved surface conformably engageable with the heel of the hand of an operator; and a traveling portion coupled to the rear surface, the traveling portion adapted to compress an earring cartridge when the earring cartridge is placed in the cradle and the grip 20 and the plunger 22 are squeezed by the hand; and wherein the traveling portion has a cradle backstop; and a tongue, the tongue being coupled to the cradle backstop and traveling into a tongue groove defined in the grip 20 when the plunger 22 and the grip 20 are squeezed, and wherein first and second stops are coupled to the plunger 22, the first and second stops abutting the grip 20 when the grip 20 and the plunger 22 are squeezed, the first and second stops limiting the slidable insertion of the plunger 22 into the grip 20 whereby; a post held by the earring cartridge may engage, a nut held by the earring cartridge without damaging the nut.

Figure 7:
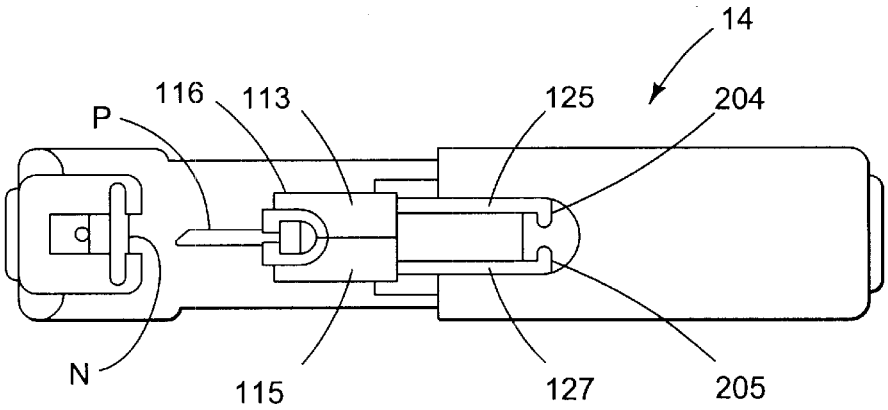
FIG. 7 is a top view of the earring cartridge as the stud is being driven toward the clutch.
Figure 8:
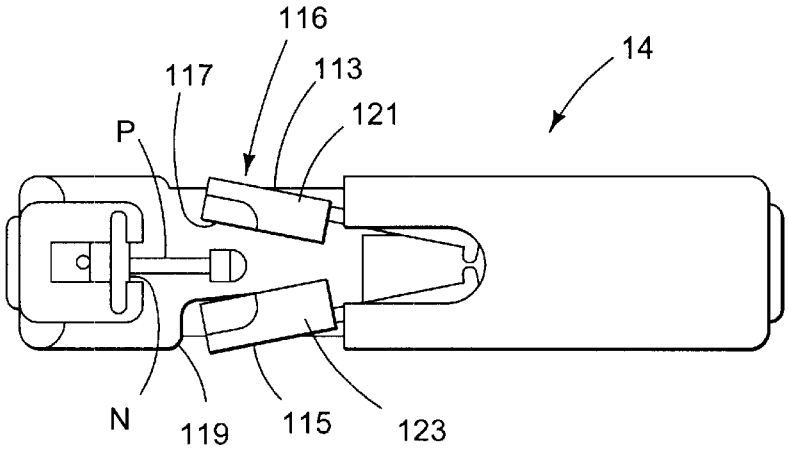
FIG. 8 is a view similar to FIG. 7 but showing the stud engaged with the clutch as also shown in FIG. 6.

Referring to FIGS. 7 and 8, it will be seen that the stud or earring post P is releasably held by oppositely disposed stud-holder halves 113 and 115. Each of the stud-holder halves 113 and 115 have a front stud-head recess 117 and 119, respectively, and a rearward, rectangular portion 121 and 123, respectively; which terminate in termini 125 and 127, respectively. Rectangular portions 121 and 123 are adapted to ride within top channel 118 of cartridge 116 with the retained stud or post P retained in captive relationship there between.

The operation of the earring cartridge is as follows. Normally, the earring cartridge sprig 142 or other biasing means forces the nut jaw 114 away from the jaw 112 as far as the bottom slot and hooked tongue 168 will allow. Ample room is provided between the nut jaw 114 and the earring jaw 112 for the insertion of an eat (not shown) to be pierced. Once the ear is placed between the nut jaw 114 and the earring jaw 112, and necessarily between the earring stud or post P and the earring nut N, the earring-cartridge stud gun 12 is squeezed to compress the earring cartridge 14. This compresses the earring cartridge 14 to bring the bases 204, 205 of the L-shaped terminal member legs 125, 127 over the hump causing a torque-like force to be applied on die two halves of the stud post holder assembly 116.

At this point, if the ear piercer is satisfied and ready to pierce the ear, he firmly squeezes the stud gun 12 causing the tang 160 to move past the back end of the assembly 116, the flexible tang 160 is free to rise up and above the plane of the earring cartridge bottom. This drives the earring stud or post P through the ear and into the flanged aperture and through the curled springs of the earring nut. In so doing, the elongated portion 150 of the nut jaw 114 compresses the earring cartridge spring 142 and travels to the rear of the earring jaw 112.

During this operation, the stud post holder assembly 116 is held in place, the flexible tang 160 (moving with the elongated nut jaw portion) moves along the bottom side of the pierced-ear earring cartridge 116 until it finally reaches the back end 164 of the stud post holder assembly 116.

The earring-cartridge box 16 is a sealable container within which the earring cartridge 14 and the pierced-ear earring E may be transported and stored until ready for use. The box 16 allows and maintains sterilization of the earring cartridge 14, and the pierced-ear earring E.

Figure 11A:
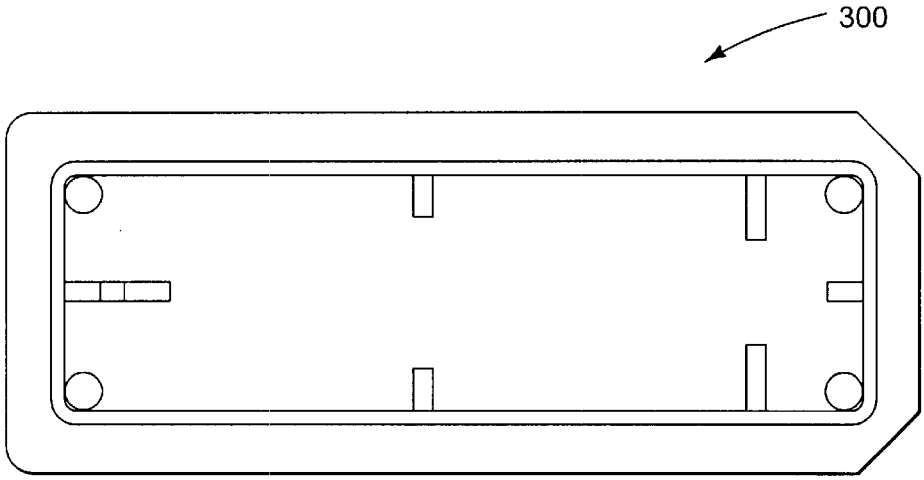
FIGS. 11A and 11B are the plan and elevation views of the packing box cover.
Figure 11B:
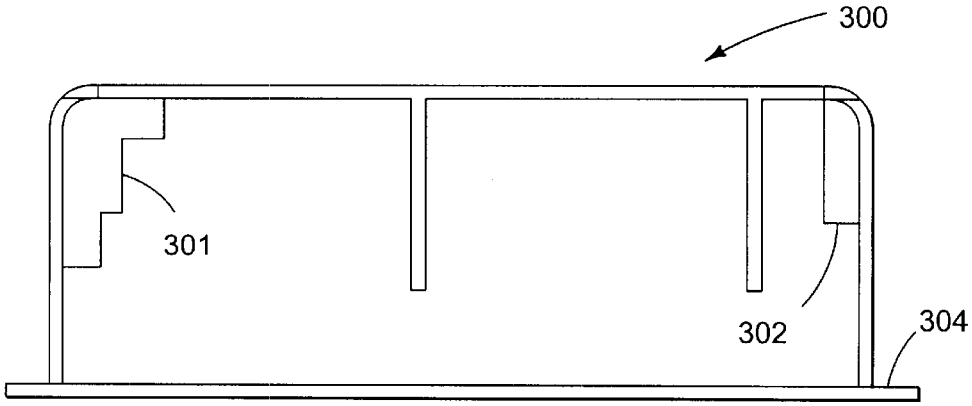

As shown in FIG. 10, the earring cartridge box 16 is constructed to conform to the top of the earring cartridge 14. The conforming top 300 of the box 16 conforms to the top exterior of the earring cartridge 14 for a close but not constricting fit. Internal indentations 301, 302 provide gripping means by which the top 300 grips the earring cartridge 14 inside. As the earring cartridge 14 may take a variety of shapes, the shape achieved by the conforming top 300 of the box 16 may also take the same variety of shapes including hinged hoops in order to accommodate the earring cartridge 14. The plan and elevation views of the conforming top 300 are shown in FIGS. 11A and 11B, respectively.

The packing box design allows the cradle 74 of the earring-cartridge stud gun 12 to fit within the box 16 past the flange 304. This allows the earring-cartridge stud gun 12 to engage the earring cartridge 14 and remove it from the box 16. This provides means by which the sterile nature of the earring cartridge 14 and the pierced-ear earring E may be maintained once the seal on the earring-cartridge box 16 has been broken. Additionally, the earring cartridge 14 may be reinserted back into the box 16 after the ear-piercing process has been performed by fitting the earring-cartridge box 16 over the earring cartridge 14 and removing the earring cartridge 14 from the cradle 74.

During manufacture and prior distribution, the earring cartridge 14 is fitted with a pierced ear earring E within a stud post holder assembly 116. The earring cartridge is then fitted within the conforming top 300 of the earring cartridge box 16. The bottom of the earring cartridge 14 is above the flange 304 and within the confines of the box 16. Sterilizing gas or the like may be introduced into the confines of the earring-cartridge box 16 so as to sterilize its entire contents and any exposed surfaces, including the earring cartridge 14 and the pierced-ear earring E. Medical-grade Tyvak paper backing or the like (not shown) may be adhesively or otherwise sealingly attached to the flange 304. Where sterilizing gas is used, it is then intentionally trapped within the earring-cartridge box 16 to preserve and maintain the sterile environment previously established. Obviously, other sterilizing procedures maybe used.

The bottom of the box 16 is sealed with a lid 310, which is shown in plan and elevation views in FIGS. 12A and 12B respectively. The lid 310 snaps shut over the flange 304, thereby providing protection for the paper backing used to seal the conforming top 300. The lid 310 is provided with pegs 311 which can fit into corresponding holes 305 of the conforming top of another packing box. Thus, this peg and hole arrangement can be used to vertically stack the packing box on top of each other.

Once the lid is snapped onto the flange of the top 300, the sealed, earring-cartridge box 16 may then be transported and stored until ready for use, maintaining the earring cartridge 14 and its pierced-ear earring E in a sterile condition until ready to use In operation, the earring-cartridge box 16 with sterilized earring cartridge 14 is used in conjunction with the earring-cartridge stud gun 12 as follows. The earring-cartridge box 16 is opened by snapping apart the lid 310. The paper backing 18 is then removed from its adhesive attachment with the flange 304. This exposes the bottom of the earring cartridge 14 and provides access to the cradle 74 to the interior of the earring-cartridge box 16. The cradle 74 of the stud gun 12 is then brought into the confines of the earring-cartridge box 16 to engage the bottom of the earring cartridge 14. Once the cradle 74 has securely engaged the earring cartridge 14, the box 16 is then removed from the top of the earring cartridge 14. The ear to be pierced may then be pierced by placing the ear between the nut jaw 114 and the post P of the pierced-ear earring E.

The plunger 22 and the grip 20 are then pressed together to force the earring post into the earring nut N, piercing the ear lobe.

Figure 9:
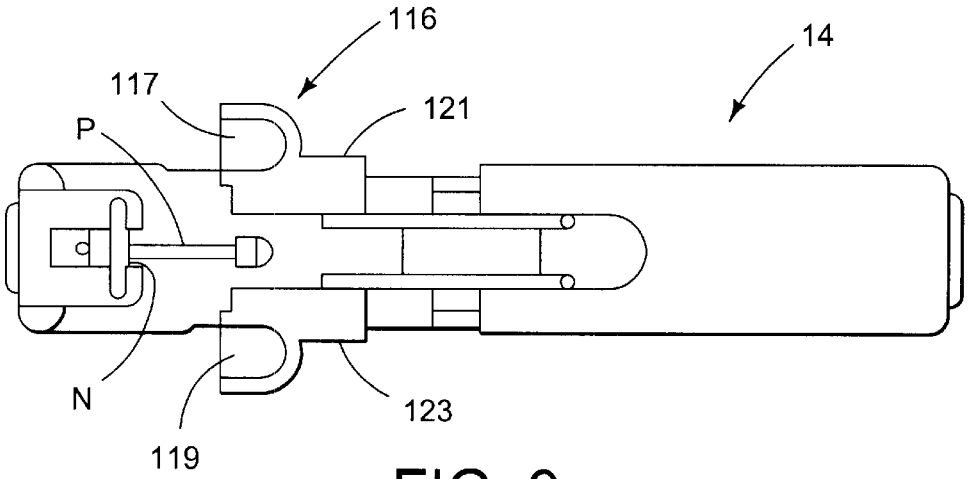
FIG. 9 is a view similar to FIGS. 7 and 8, showing the sequential action of the stud holders opening up but being retained to prevent reuse of the earring cartridge.

When fully compressed, the upper and lower abutment stops 28, 30 engage the grip 20 to stop all forward travel. Upon full compression, the ear has been pierced; and the earring post P has engaged the nut N. Pressure is then released from the hand upon the earring-cartridge stud gun 12, the pierced-ear earring cartridge halves 113 and 115 (FIG. 8) open up away from the pierced-ear earring E, the pierced-ear earring nut N is disengaged from the nut jaw 114, the ear has been pierced, and the earring-cartridge stud gun 12 with the earring cartridge 14 may then be removed from the area adjacent the pierced ear. Because of the termini portions 125 and 127 being retained, as seen in FIG. 9, the stud-holder halves 113 and 115 do not fall away, and preclude reloading of the cartridge to negate sterility. That is, the right-angle protuberances at the ends of termini portions 125 and 127 captively retain the cartridge halves 113 and 115 (FIG. 9) to prevent reloading of a stud and reuse of the earring cartridge.

The conforming top 300 may then be re-fitted over the used earring cartridge whereby the earring cartridge 14 may be engaged within the top 300 and removed from the cradle 74 Following that the top 300 may be sealed shut by snapping its lid 310 back on. By using the packing box 16, the earring cartridge 14 need never be touched by human hands or other contaminating surface prior to, during, or after the ear-piercing process.

Generally, the earring-cartridge packing box 16 is made of clear or other see-through plastics or materials so that the earring cartridge 14 and its pierced-ear earring E may be easily visible prior to the ear-piercing process. However, it may also be made of opaque or translucent material. The earring-cartridge 14 and the earring-cartridge stud gun 12 may be made of lightweight but durable plastics that are easily formed into the appropriate shapes for use as set forth above. In preferred embodiments, the packing box and/or the cartridge may be made from one or more plastic materials including, but not limited to, the following materials: polyester, polycarbonate, paper, foil, polyimide, polyethylene, polyvinyl chloride, polystyrene, and acrylomitrite-butadiene-styrene (ABS) polymers. Alternatively, the box and/or cartridge may be made from non-plastic materials such as metal or paper.

Thus, in the instant invention a cartridge 14 is now designed not merely as a container for the pierced-ear Earring and the earring Nut N, but also acts as a loading tool by which the earring-cartridge stud gun 12 may be loaded. Moreover, the cartridge 14 is stored and transported in stackable packing boxes 300, which provide sealed secure storage for the cartridge before and after use and which are adapted for convenient vertical stacking. It can be readily seen that by using the system disclosed that sterility and ease of handling for user of the system is accomplished.

While the present invention as been described with reference a particular embodiments, it is recognized that additional variations of the present invention may be devised without departing from the inventive concept.

What is claimed is:

1. An carrying cartridge and stud gun system for providing sterile ear piercing comprising:

an earring cartridge carrying a stud having a post and a nut in slidably aligned, spaced apart, and oppositely opposed placement so that an ear part may be placed between said post and said nut for piercing comprising a stud post holder assembly for holding the stud, an earring jaw for movably carrying said stud post holder assembly, and a nut jaw for alignedly holding said nut opposite said stud, said nut jaw having a nut jaw extension for slidably engaging the nut jaw with said earring jaw, said nut jaw extension and the stud post holder assembly interact to produce a torque-like force on the stud post holder assembly causing it to rotatably open when said assembly moves through the earring jaw when said earring cartridge is compressed to bring said earring jaw towards said nut jaw for engaging said post with said nut;

wherein the stud post holder assembly for holding the stud is in two halves, each half comprising a main body, a front stud head adaptor attached to the front side of the body and an L-shaped terminal member having a base and a leg attached to the rear side of the body, wherein the front stud head adaptor is recessed to receive the stud head and forms a through hole adapted to hold a hinged hoop earring.

2. The earring cartridge and stud gun system of claim 1 wherein the top surface of the earring jaw has a radial cavity adapted to accommodate the hinged hoop earring stud.

3. The earring cartridge and stud gun system of claim 1 wherein the hinged hoop earring is held within the stud post holder assembly such that the hoop curves away from the stud.

4. The earring cartridge and stud gun system of claim 1 wherein the hinged hoop earring is held within the stud post holder assembly such that the hoop curves towards the stud.

5. An earring cartridge and stud gun system for providing sterile ear piercing comprising:

an earring cartridge carrying a stud having a post and a nut in slidably aligned, spaced apart, and oppositely opposed placement so that an ear part may be placed between said post and said nut for piercing comprising a stud post holder assembly for holding the stud, an earring jaw for movably carrying said stud post holder assembly, and a nut jaw for alignedly holding said nut opposite said stud, said nut jaw having a nut jaw extension for slidably engaging the nut jaw with said earring jaw, said nut jaw extension and the stud post holder assembly interact to produce a torque-like force on the stud post holder assembly causing it to rotatably open when said assembly moves through the earring jaw when said earring cartridge is compressed to bring said earring jaw towards said nut jaw for engaging said post with said nut;

wherein the nut has a backing shield to prevent the end of the stud post from contacting a subject's body after the stud post is engaged by the nut.

6. An earring cartridge and stud gun system for providing sterile ear piercing comprising:

an earring cartridge carrying a stud having a post and a nut in slidably aligned, spaced apart, and oppositely opposed placement so that an ear part may be placed between said post and said nut for piercing comprising a stud post holder assembly for holding the stud, an earring jaw for movably carrying said stud post holder assembly, and a nut jaw for alignedly holding said nut opposite said stud, said nut jaw having a nut jaw extension for slidably engaging the nut jaw with said earring jaw, said nut jaw extension and the stud post holder assembly interact to produce a torque-like force on the stud post holder assembly causing it to rotatably open when said assembly moves through the earring jaw when said earring cartridge is compressed to bring said earring jaw towards said nut jaw for engaging said post with said nut;

wherein the earring jaw has a top channel for holding the body of each half of the stud post holder such that said stud post holder assembly can slide in and out of the carrying jaw.

7. An earring cartridge and stud gun system for providing sterile ear piercing comprising:

an earring cartridge carrying a stud having a post and a nut in slidably aligned, spaced apart, and oppositely opposed placement so that an ear part may be placed between said post and said nut for piercing comprising a stud post holder assembly for holding the stud, an earring jaw for movably carrying said stud post holder assembly, and a nut jaw for alignedly holding said nut opposite said stud, said nut jaw having a nut jaw extension for slidably engaging the nut jaw with said earring jaw, said nut jaw extension and the stud post holder assembly interact to produce a torque-like force on the stud post holder assembly causing it to rotatably open when said assembly moves through the earring jaw when said earring cartridge is compressed to bring said earring jaw towards said nut jaw for engaging said post with said nut;

wherein the earring jaw has a bottom channel adapted for slidably engaging the nut jaw extension.

8. The earring cartridge and stud gun system of claim 7 wherein the earring cartridge further comprises a nut jaw retention system comprising:

a bottom side of said earring jaw adjacent said bottom channel and defining an opening between an interior said an exterior of said earring jaw, said opening parallel to a length of said bottom side and extending from a rear portion of said earring jaw to a point just past a midpoint between said rear portion and a front portion of said earring jaw, said opening accommodating a hook coupled to said nut jaw introduced into said opening whereby said hook may travel along said opening and may be caught at a forward end thereof at said point just past said midpoint.

9. The earring cartridge and stud gun system of claim 8 wherein the earring jaw further comprises a biasing engagement mechanism for engaging said earring jaw and said nut jaw that also tends to urge said earring jaw away from said nut jaw comprising:

a spring post, said spring post coupled centrally to an interior rear wall of said bottom channel, said spring post extending into said bottom channel generally parallel to a bottom side approximately one-quarter the distance between a rear and a front of said earring jaw.

10. The earring cartridge and stud gun system of claim 9 wherein said earring jaw further comprises:

a plurality of ribs, said plurality of ribs present on an exterior of said earring jaw, generally opposite said bottom channel, said ribs providing means by which secure manual engagement may be made of the exterior of said earring jaw.

11. The earring cartridge and stud gun system of claim 10 wherein said nut jaw further comprises:

nut holding means for holding a nut corresponding to an earring post in alignment with said earring post;

extension means for extending said nut holding means away from said earring jaw; and slidable engagement means for slidably engaging said earring jaw, said slidable engagement means coupled to said extension means.

12. The earring cartridge and stud gun system of claim 11 wherein said nut holding means further comprises:

a nut holder; and support means for supporting said nut holder in a spaced apart relationship with said extension means.

13. The earring cartridge and stud gun system of claim 12 wherein said nut holder further comprises:

a block, said block coupled to said support means and defining first and second nut grooves within which an earring nut may fit, said first nut groove perpendicular to said second nut groove; and a finger, said finger rising up from a floor of said block in said first groove, said finger capable of engaging with slight compression a nut fitted in said first and second nut grooves whereby said nut may be securely held in place by said finger in said first and second grooves of said block yet easily disengaged from said block.

14. The earring cartridge and stud gun system of claim 13 wherein said support means for supporting said nut holder further comprises:

an upright portion supporting said block away from said extension means whereby a void is defined between said upright portion, said extension means, and said earring jaw to provide room for an ear, said upright portion having a width approximately the same as a width of said earring jaw to provide means by which said nut jaw may be manually engaged; and a plurality of ribs, said plurality of ribs present on an outward facing portion of said upright portion opposite said void, said ribs providing means by which secure manual engagement may be made of the exterior of said nut jaw.

15. The earring cartridge and stud gun system of claim 12 wherein said extension means further comprises:

a base portion coupled to said nut holding means, said base portion having a width approximately the same as a width of said earring jaw to provide means by which said nut holding means may be sturdily supported and to provide means by which said nut jaw may be engaged by said earring jaw thereby obstructing further slidable travel of said nut jaw into said earring jaw; and a neck portion, said neck portion coupled to said base portion and having a width approximately the same as a width of said bottom channel so that said neck portion may slide into said bottom channel.

16. The earring cartridge and stud gun system of claim 15 wherein said extension means further comprises:

a tongue portion, said tongue portion extending from said neck portion and terminating in a hook, said tongue portion descending at an angle from said neck portion whereby said catch may engage a terminal end of an opening present in a bottom side of said earring jaw.

17. The earring cartridge and stud gun system of claim 12 wherein said slidable engagement means further comprises:

an elongated portion slidably engaging the interior of said bottom channel.

18. The earring cartridge and stud gun system of claim 17 wherein:

said elongated portion defines a bore wherein said bore is defined by first and second nut jaw extensions, said first nut jaw extension extending above said bore and said second nut jaw extension, said first and second nut jaw extensions having oppositely opposed curved sections that serve to retain said biasing means within said bore and that serve to define corresponding gaps between said first and second nut jaw extensions and wherein said biasing means is a spring.

19. The earring cartridge and stud gun system of claim 1 wherein said earring jaw further comprises:

two intermediate channels configured to adaptably receive the leg of the terminal member of each half of the stud post holder assembly whereby the legs slide within said intermediate channels when said stud post holder assembly slides in and out of the earring jaw.

20. The earring cartridge and stud gun system of claim 19 wherein the earring cartridge further comprises a flexible tang and a hump juxtaposed with the flexible tang such that when the rear end of the body of the stud post holder assembly moves past the flexible tang, the bases of the terminal members are forced up onto the hump.

21. The earring cartridge and stud gun system of claim 20 wherein the flexible tang is shorter than the legs of the terminal members.

22. The earring cartridge and stud gun system of claim 21 wherein the flexible tang is moldably attached to the hump.

23. The earring cartridge and stud gun system of claim 22 wherein the hump is attached to the upper surface of the nut jaw extension.

24. The earring cartridge and stud gun system of claim 23 wherein said flexible tang is flared upward to engage an underside of said post holder assembly so as to better open said assembly once said assembly moves past the tang.

25. The earring cartridge and stud gun system of claim 1 further comprising an alignment system for the two halves of the stud post holder assembly comprising a peg jutting out of the outer surface of one body and the other body having a cavity sized to adaptably receive the peg such that when the two halves of the stud post holder assembly are assembled together in alignment the peg is received within the cavity.

26. An earring cartridge and stud gun system for providing sterile eat piercing comprising:

an earring cartridge carrying a stud having a post and a nut in slidably aligned, spaced apart, and oppositely opposed placement so that an ear part may be placed between said post and said nut for piercing comprising a stud post holder assembly for holding the stud, an earring jaw for movably carrying said stud post holder assembly, and a nut jaw for alignedly holding said nut opposite said stud, said nut jaw having a nut jaw extension for slidably engaging the nut jaw with said earring jaw, said nut jaw extension and the stud post holder assembly interact to produce a torque-like force on the stud post holder assembly causing it to rotatably open when said assembly moves through the earring jaw when said earring cartridge is compressed to bring said earring jaw towards said nut jaw for engaging said post with said nut;

a stackable packing box for housing the earring cartridge during transport and storage, said box being congruently configured to said earring cartridge and conformably accommodating said earring cartridge and being sealable to medically seal said earring cartridge within it.

27. The earring cartridge and stud gun system of claim 26 wherein the stackable packing box further comprises:

a conforming top and a lid wherein either one of the conforming top or the lid has a plurality of pegs and the other has a plurality of holes adapted to receive the pegs whereby when a first box is placed on top of a second box the pegs in the first box fit within the holes in the second box thereby allowing the packing boxes to be stacked.

28. The earring cartridge and stud gun system of claim 27 wherein the conforming top further comprises:

a seal to temporarily seal said earring cartridge within said stackable packing box;

whereby said earring cartridge may be placed and sealed within said box for transport and storage, and thereafter said box being unsealed to expose said earring cartridge for use.

29. An earring cartridge and stud gun system for providing sterile ear piercing comprising:

an earring cartridge carrying a stud having a post and a nut in slidably aligned, spaced apart, and oppositely opposed placement so that an ear part may be placed between said post and said nut for piercing comprising a said post holder assembly for holding the stud, an earring jaw for movably carrying said stud post holder assembly, and a nut jaw for alignedly holding said nut opposite said stud, said nut jaw having a nut jaw extension for slidably engaging the nut jaw with said earring jaw, said nut jaw extension and the stud post holder assembly interact to produce a torque-like force on the stud post holder assembly causing it to rotatably open when said assembly moves through the earring jaw when said earring cartridge is compressed to bring said earring jaw towards said nut jaw for engaging said post with said nut;

an earring cartridge stud gun for engaging an earring cartridge, comprising a grip; a plunger, said plunger slidably engaging said grip; biasing means for biasing said plunger away from said grip, said grip having a front curved surface conformably engageable with the fingers of the hand of an operator, a cradle extension projecting forward of said front curved surface, said cradle extension having an upper surface spaced apart from a lower surface to define a tongue groove; and a cradle forestop projecting upwardly from an end of said cradle extension, said plunger having a rear curved surface conformably engageable with the heel of the hand of an operator; and a travelling portion coupled to said rear surface, said travelling portion adapted to compress an earring cartridge when the earring cartridge is placed in said cradle and said grip and said plunger are squeezed by said hand; and wherein said travelling portion has a cradle backstop; and a tongue, said tongue being coupled to said cradle backstop and travelling into a tongue groove defined in said grip when said plunger and said grip are squeezed, and wherein first and second stops are coupled to said plunger, said first and second stops abutting said grip when said grip and said plunger are squeezed, said first and second stops limiting the slidable insertion of said plunger into said grip whereby; a post held by the earring cartridge may engage a nut held by the earring cartridge without damaging said nut.

30. The earring cartridge and stud gun system of claim 29 further comprising a stackable packing box for housing the earring cartridge during transport and storage, said box being congruently configured to said earring cartridge and conformably accommodating said earring cartridge and being sealable to medically seal said earring cartridge within it.

31. The earring cartridge and stud gun system of claim 30 wherein the stackable packing box further comprises:

a conforming top and a lid wherein either one of the conforming top or the lid has a plurality of pegs and the other has a plurality of holes adapted to receive the pegs whereby when a first box is placed on top of a second box the pegs in the first box fit within the holes in the second box thereby allowing the packing boxes to be stacked.

32. The earring cartridge and stud gun system of claim 31 wherein the conforming top further comprises:

a seal to temporarily seal said earring cartridge within said stackable packing box;

whereby said earring cartridge may be placed and sealed within said box for transport and storage, and thereafter said box being unsealed to expose said earring cartridge for use.

33. The earring cartridge and stud gun system of claim 32 whereby said earring cartridge is used by placement within said cradle, said cradle receiving and removing said earring cartridge from said stackable packing box to provide and present said stud and said nut in aligned position for piercing said body part without the necessity of handling said earring cartridge with the hands of the operator.

34. An earring cartridge carrying a hinged hoop stud with a post and a nut in slidably aligned, spaced apart, and oppositely opposed placement so that an ear part may be placed between said post and said nut for piercing providing sterile ear piercing comprising:

a stud post holder assembly for holding the stud in two halves, each half comprising a main body, a front stud head adaptor attached to the front side of the body and an L-shaped terminal member having a base and a leg attached to the rear side of the body, wherein the front stud head adaptor is recessed to receive the stud head and forms a through hole adapted to hold a hoop earring stud;

an alignment system for the two halves of the stud post holder assembly comprising a peg jutting out of the outer surface of one body and the other body having a cavity sized to adaptably receive said peg such that when the two halves of the stud post holder assembly are assembled together in alignment said peg is received within said cavity;

an earring jaw for movably carrying said stud post holder assembly, wherein the earring jaw has a top channel for holding the body of each half of the stud post holder such that said stud post holder assembly can slide in and out of the earring jaw, a bottom channel adapted for slidably engaging the nut jaw extension, two intermediate channels configured to adaptably receive the legs of the terminal member of each half of the stud post holder assembly whereby the legs slide within said intermediate channels when said stud post holder assembly slides in and out of the earring jaw, and a plurality of ribs, said plurality of ribs present on an exterior of said earring jaw, generally opposite said bottom channel, said ribs providing means by which secure manual engagement may be made of the exterior of said earring jaw;

a nut jaw for alignedly holding said nut opposite said stud, said nut jaw having a nut holder and a nut jaw extension for slidably engaging the nut jaw with said earring jaw, wherein;

the nut holder comprises a block, said block coupled to a support means for supporting the nut holder and defining first and second nut grooves within which an earring nut may fit, said first nut groove perpendicular to said second nut groove, and a finger, said finger rising up from a floor of said block in said first groove, said finger capable of engaging with slight compression a nut fitted in said first and second nut grooves whereby said nut may be securely held in place by said finger in said first and second grooves of said block yet easily disengaged from said block, wherein the support means for supporting the nut holder comprise an upright portion supporting said block away from said nut jaw extension whereby a void is defined between said upright portion, said nut jaw extension, and said earring jaw to provide room for an ear, said upright portion having a width approximately the same as a width of said earring jaw to provide means by which said nut jaw may be manually engaged, and a plurality of ribs, said plurality of ribs present on an outward facing portion of said upright portion opposite said void, said ribs providing means by which secure manual engagement may be made of the exterior of said nut jaw, and the nut jaw extension comprises a base portion coupled to said nut holding means, said base portion having a width approximately the same as a width of said earring jaw to provide means by which said nut holding means may be sturdily supported and to provide means by which said nut jaw may be engaged by said earring jaw thereby obstructing further slidable travel of said nut jaw into said earring jaw; a neck portion, said neck portion coupled to said base portion and having a width approximately the same as a width of said bottom channel so that said neck portion may slide into said bottom channel, and a tongue portion, said tongue portion extending from said neck portion and terminating in a hook, said tongue portion descending at an angle from said neck portion whereby said catch may engage a terminal end of an opening present in a bottom side of said earring jaw, and an elongated portion slidably engaging the interior of said bottom channel, wherein said elongated portion defines a bore wherein said bore is defined by first and second extensions, said first extension extending above said bore and said second extension, said first and second extensions having oppositely opposed curved sections that serve to retain a spring within said bore and that serve to define corresponding gaps between said first and second extensions;

a nut jaw retention system comprising a bottom side of said earring jaw adjacent said bottom channel and defining an opening between an interior and an exterior of said earring jaw, said opening parallel to a length of said bottom side and extending from a rear portion of said earring jaw to a point just past a midpoint between said rear portion and a front portion of said earring jaw, said opening accommodating a hook coupled to said nut jaw introduced into said opening whereby said hook may travel along said opening and may be caught at a forward end thereof at said point just past said midpoint;

a biasing engagement mechanism for engaging said earring jaw and said nut jaw that also tends to urge said earring jaw away from said nut jaw comprising a spring post, said spring post coupled centrally to an interior rear wall of said bottom channel, said spring post extending into said bottom channel generally parallel to a bottom side approximately one-quarter the distance between a rear and a front of said earring jaw; and a flexible tang and a hump juxtaposed with the flexible tang such that when the rear end of the body of the stud post holder assembly moves past the flexible tang, the bases of the terminal members are forced up onto the hump and wherein the flexible tang is shorter than the legs of the terminal members and wherein the hump is attached to the upper surface of the nut jaw extension and wherein said flexible tang is flared upward to engage an underside of said post holder assembly so as to better open said assembly once said assembly moves past the tang.

35. An earring cartridge system for use with a hinged hoop stud comprising:

the earring cartridge of claim 34; and an earring cartridge stud gun.

36. The earring cartridge and stud gun system of claim 34 further comprising:

a stackable packing box for housing the earring cartridge during transport and storage, said box being congruently configured to said earring cartridge and conformably accommodating said earring cartridge and being sealable to medically seal said earring cartridge within it.

37. The earring cartridge and stud gun system of claim 36 wherein the stackable packing box further comprises:

a conforming top and a lid wherein either one of the conforming top or the lid has a plurality of pegs and the other has a plurality of holes adapted to receive the pegs whereby when a first box is placed on top of a second box the pegs in the first box fit within the holes in the second box thereby allowing the packing boxes to be stacked.

38. The earring cartridge and stud gun system of claim 37 wherein the cartridge housing member further comprises:

a seal to temporarily seal said earring cartridge within said stackable packing box;

whereby said earring cartridge may be placed and sealed within said box for transport and storage, and thereafter said box being unsealed to expose said earring cartridge for use.

* * * * *